US011610534B2

(12) United States Patent
Sun et al.

(10) Patent No.: US 11,610,534 B2
(45) Date of Patent: Mar. 21, 2023

(54) DISPLAY HAVING SUB-PIXEL STRUCTURE WITH A PLURALITY OF LIGHT EMITTING ELEMENTS

(71) Applicant: CHONGQING KONKA PHOTOELECTRIC TECHNOLOGY RESEARCH INSTITUTE CO., LTD., Chongqing (CN)

(72) Inventors: Jia Sun, Chongqing (CN); Ying-chi Wang, Chongqing (CN); Chia-huang Yen, Chongqing (CN); Li-wei Kung, Chongqing (CN); Cheng-ming Liu, Chongqing (CN)

(73) Assignee: CHONGQING KONKA PHOTOELECTRIC TECHNOLOGY RESEARCH INSTITUTE CO., LTD., Chongqing (CN)

( * ) Notice: Subject to any disclaimer, the term of this patent is extended or adjusted under 35 U.S.C. 154(b) by 0 days.

(21) Appl. No.: 17/360,576

(22) Filed: Jun. 28, 2021

(65) Prior Publication Data

US 2021/0366372 A1 Nov. 25, 2021

Related U.S. Application Data

(63) Continuation of application No. PCT/CN2020/091373, filed on May 20, 2020.

(51) Int. Cl.
*G09G 3/32* (2016.01)

(52) U.S. Cl.
CPC ..... *G09G 3/32* (2013.01); *G09G 2300/0452* (2013.01); *G09G 2300/0809* (2013.01); *G09G 2320/043* (2013.01)

(58) Field of Classification Search
CPC ..... G09G 3/32
(Continued)

(56) References Cited

U.S. PATENT DOCUMENTS

2003/0103150 A1 6/2003 Catrysse et al.
2006/0103608 A1* 5/2006 Kwak ..... G09G 3/3233 345/76

(Continued)

FOREIGN PATENT DOCUMENTS

CN 102472907 A 5/2012
CN 103137653 A 6/2013

(Continued)

OTHER PUBLICATIONS

International Search Report issued in corresponding International Application No. PCT/CN2020/091373, dated Jan. 28, 2021, pp. 1-9, Beijing, China.
Notice of Allowance issued in corresponding CN Application No. 202010432369.5, dated Mar. 2, 2022.

(Continued)

*Primary Examiner* — Long D Pham
(74) *Attorney, Agent, or Firm* — Hauptman Ham, LLP

(57) ABSTRACT

A sub-pixel array and a display are provided. The sub-pixel structure includes a driving module, a first selection module, a second selection module, a switch module, a first light-emitting element, and a second light-emitting element. The first selection module is configured to control conduction between the driving module and an anode of the first light-emitting element or conduction between the driving module and an anode of the second light-emitting element through a first control signal. The second selection module is configured to control grounding of a cathode of the first light-emitting element or grounding of a cathode of the second light-emitting element through a second control signal.

20 Claims, 3 Drawing Sheets

(58) Field of Classification Search
USPC ..... 345/214
See application file for complete search history.

(56) References Cited

U.S. PATENT DOCUMENTS

| | | | | |
|---|---|---|---|---|
| 2008/0238328 | A1 | 10/2008 | Shin et al. | |
| 2011/0304593 | A1 | 12/2011 | Huang et al. | |
| 2016/0181337 | A1* | 6/2016 | Gu | H01L 27/3248 257/40 |
| 2017/0200415 | A1* | 7/2017 | Noguchi | H01L 51/5012 |
| 2018/0137818 | A1 | 5/2018 | Kim et al. | |
| 2018/0226019 | A1* | 8/2018 | Tong | G09G 3/3225 |
| 2019/0066583 | A1 | 2/2019 | Chang et al. | |
| 2019/0108790 | A1* | 4/2019 | Liang | H01L 51/5225 |

FOREIGN PATENT DOCUMENTS

| | | | |
|---|---|---|---|
| CN | 103413519 | A | 11/2013 |
| CN | 107507568 | A | 12/2017 |
| CN | 107644948 | A | 1/2018 |
| CN | 108364607 | A | 8/2018 |
| CN | 110197638 | A | 9/2019 |
| CN | 110264956 | A | 9/2019 |
| CN | 110400536 | A | 11/2019 |
| CN | 110459169 | A | 11/2019 |
| JP | 2007052087 | A | 3/2007 |
| TW | 201430806 | A | 8/2014 |

OTHER PUBLICATIONS

The First Office Action issued in corresponding CN application No. 202010432369.5 dated Jan. 21, 2022.

* cited by examiner

DISPLAY HAVING SUB-PIXEL STRUCTURE WITH A PLURALITY OF LIGHT EMITTING ELEMENTS

CROSS-REFERENCE TO RELATED APPLICATIONS

The present application is a continuation of International Application No. PCT/CN2020/091373, filed on May 20, 2020, the disclosure of which is hereby incorporated by reference in its entirety.

TECHNICAL FIELD

This disclosure relates to the field of display technology, in particular to a sub-pixel structure and a display.

BACKGROUND

Traditional micro light-emitting diodes (LED) are controlled by currents. Since the inorganic gallium nitride material, from which the Micro LED is made, will rapidly decay under long-term driving, the brightness of the Micro LED will decrease and the service life of the Micro LED will be decreased. At the same time, due to the threshold voltage drift of the thin film transistor and the different decay rates of different RGB organic materials, the Micro LED is prone to inconsistent brightness after a certain period of time. Different display images are driven by different currents, and the resulting decay rates are also different. Displaying a static image for a long period of time will cause uneven display or image retention (i.e., afterimage).

Brightness of the Micro LED is controlled based on the current, and the current is controlled based on the voltage. The micro LED has a poor uniformity due to mass transfer process. In addition, thin film transistors also have poor uniformity. At normal high grayscales, the brightness is high, and it is difficult for the human eye to distinguish the difference in brightness. However, at low grayscales, the display drive current is small, and the variability of thin film transistors will affect the display effect, resulting in uneven display distinguished by the human eye, and the pictures turn grainy, that is, display brightness is uneven at low grayscales.

Therefore, the existing technology needs to be improved and promoted.

SUMMARY

In view of the above-mentioned shortcomings of the related art, the disclosure aims at providing a sub-pixel structure and a display. By using dual-electrode separation, it is possible to achieve display of time-sharing control and zone control, slow down the decay rate of material, prolong the service life, and reduce afterimage formed due to difference in material decay.

In order to achieve above objectives, the disclosure adopts the following technical solutions.

A sub-pixel structure is provided. The sub-pixel structure includes a driving module, a first selection module, a second selection module, a switch module, a first light-emitting element, and a second light-emitting element. The driving module has a first terminal coupled with a first supply terminal and a second terminal coupled to a first terminal of the first selection module. The first selection module has a second terminal coupled with an anode of the first light-emitting element and an anode of the second light-emitting element, and has a third terminal configured to receive a first control signal, where the first control signal is used to control conduction between the driving module and the anode of the first light-emitting element or conduction between the driving module and the anode of the second light-emitting element. The second selection module has a first terminal coupled with a cathode of the first light-emitting element and a cathode of the second light-emitting element, and has a second terminal configured to receive a second control signal, where the second control signal is used to control grounding of the cathode of the first light-emitting element or grounding of the cathode of the second light-emitting element. The switch module has a first terminal coupled with the anode of the first light-emitting element and the anode of the second light-emitting element, and has a second terminal coupled with the cathode of the first light-emitting element and the cathode of the second light-emitting element. The switch module has a third terminal configured to receive a third control signal and a fourth control signal, where the third control signal is used to control simultaneous conduction or non-simultaneous conduction of the anode of the first light-emitting element and the anode of the second light-emitting element, and the fourth control signal is used to control simultaneous conduction or non-simultaneous conduction of the cathode of the first light-emitting element and the cathode of the second light-emitting element.

In an implementation, the switch module includes a first switch unit and a second switch unit. The first switch unit has a first terminal coupled with the anode of the first light-emitting element, a second terminal coupled with the anode of the second light-emitting element, and a third terminal configured to receive the third control signal, where the third control signal is used to control simultaneous conduction or non-simultaneous conduction of the anode of the first light-emitting element and the anode of the second light-emitting element. The second switch unit has a first terminal coupled with the cathode of the first light-emitting element, a second terminal coupled with the cathode of the second light-emitting element, and a third terminal configured to receive the fourth control signal, where the fourth control signal is used to control simultaneous conduction or non-simultaneous conduction of the cathode of the first light-emitting element and the cathode of the second light-emitting element.

In an implementation, the first selection module includes a first switch transistor and a second switch transistor. The first switch transistor has a first terminal coupled with the driving module, a second terminal coupled with the anode of the first light-emitting element, and a third terminal configured to receive the first control signal. The second switch transistor has a first terminal coupled with the driving module, a second terminal coupled with the anode of the second light-emitting element, and a third terminal configured to receive the first control signal.

In an implementation, the second selection module includes a third switch transistor and a fourth switch transistor. The third switch transistor has a first terminal coupled with the cathode of the first light-emitting element, a second terminal configured to receive the second control signal, and a third terminal coupled with a second supply terminal. The fourth switch transistor has a first terminal coupled with the cathode of the second light-emitting element, a second terminal configured to receive the second control signal, and a third terminal coupled with the second supply terminal.

In an implementation, the first switch unit includes a fifth switch transistor, and the fifth switch transistor has a first terminal coupled with the anode of the first light-emitting element, a second terminal coupled with the anode of the second light-emitting element, and a third terminal configured to receive the third control signal.

In an implementation, the second switch unit includes a sixth switch transistor, and the sixth switch transistor includes a first terminal coupled with the cathode of the first light-emitting element, a second terminal coupled with the cathode of the second light-emitting element, and a third terminal configured to receive the fourth control signal.

In an implementation, the driving module includes a seventh switch transistor, and the seventh switch transistor has a first terminal coupled with the first supply terminal, a second terminal coupled with the first selection module, and a third terminal coupled with a control signal input terminal.

In an implementation, the sub-pixel structure further includes a data module and a maintenance module. The data module is coupled with a scan line, a data line, and the driving module. The maintenance module has one terminal coupled with the first supply terminal and the other terminal coupled with a first terminal of the data module and a third terminal of the driving module, and the maintenance module is configured to maintain a stable potential difference between the driving module and the first supply terminal. The data module has a second terminal coupled with the data line and a third terminal coupled with the scan line. The scan line is configured to turn on or turn off the data module. The data line is configured to provide data information when the data module is turned on.

In an implementation, the data module includes an eighth switch transistor, and the eighth switch transistor has a first terminal coupled with the data line, a second terminal coupled with the third terminal of the driving module and the other terminal of the maintenance module, and a third terminal coupled with the scan line.

A display is provided. The display includes a pixel array. The pixel array includes at least one pixel circuit, and the at least one pixel circuit includes the above three sub-pixel structures.

Compared with the related art, a sub-pixel array and a display are provided. The sub-pixel structure includes the driving module, the first selection module, the second selection module, the switch module, the first light-emitting element, and the second light-emitting element. The first selection module is configured to control conduction between the driving module and the anode of the first light-emitting element or conduction between the driving module and the anode of the second light-emitting element through the first control signal. The second selection module is configured to control grounding of the cathode of the first light-emitting element or grounding of the cathode of the second light-emitting element through the second control signal. The switch module is configured to control simultaneous conduction or non-simultaneous conduction of the anode of the first light-emitting element and the anode of the second light-emitting element through the third control signal and to control simultaneous conduction or non-simultaneous conduction of the cathode of the first light-emitting element and the cathode of the second light-emitting element through the fourth control signal. By using dual-electrode separation, it is possible to achieve display of time-sharing control and zone control, slow down the decay rate of material, prolong the service life, and reduce after-image formed due to difference in material decay.

DETAILED DESCRIPTION

A sub-pixel structure and a display are provided. By using dual-electrode separation, it is possible to achieve display of time-sharing control and zone control, slow down the decay rate of material, prolong the service life, and reduce after-image formed due to difference in material decay.

Objectives, technical solutions, and advantages of the disclosure will be described clearly and completely hereinafter with reference to the accompanying drawings in the implementations of the disclosure. It is noted that the implementations described herein are used to merely explain rather than limit the disclosure.

Figure 1:
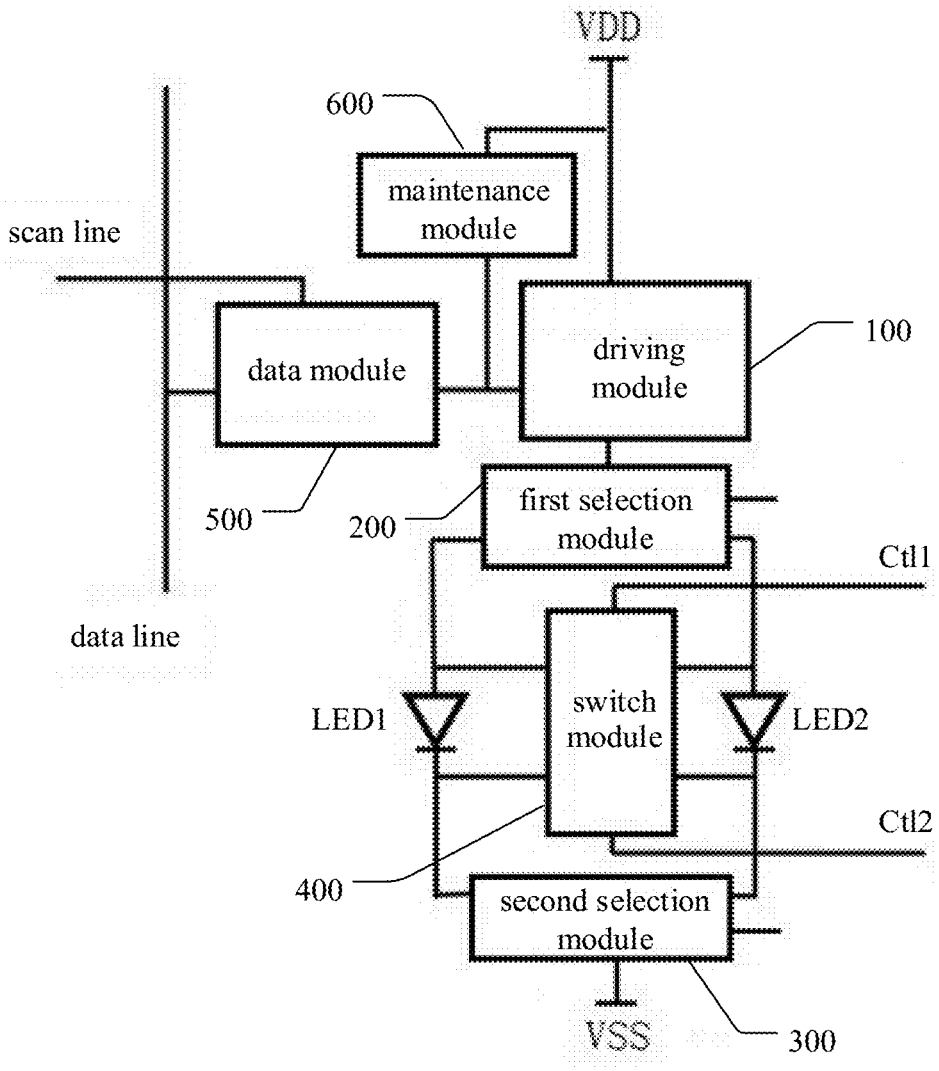
FIG. 1 is a block diagram of a sub-pixel structure of the disclosure.

Referring to FIG. 1, a sub-pixel structure is provided. The sub-pixel structure includes a driving module 100, a first selection module 200, a second selection module 300, a switch module 400, a first light-emitting element LED1, and a second light-emitting element LED2. The driving module 100 has a first terminal coupled with a first supply terminal VDD and a second terminal coupled to a first terminal of the first selection module 200. The first selection module 100 has a second terminal coupled with an anode of the first light-emitting element LED1 and an anode of the second light-emitting element LED2, and has a third terminal configured to receive a first control signal. The first control signal is used to control conduction between the driving module 100 and the anode of the first light-emitting element LED1 or conduction between the driving module 100 and the anode of the second light-emitting element LED2. The driving module 100 is used to provide a driving circuit for the first light-emitting element LED1 and the second light-emitting element LED2. When the anode of the first light-emitting element LED1 is conducted to the driving module 100, it means that a driving current of the driving module 100 flows to the anode of the first light-emitting element LED1. When the anode of the second light-emitting element LED2 is conducted to the driving module 100, it means that the driving current of the driving module 100 flows to the anode of the second light-emitting element LED2. In this way, two separate electrodes (i.e., two separate anodes) are provided and control of the two anodes is realized, so as to facilitate the subsequent realization of display of time-sharing control and zone control.

The second selection module 300 has a first terminal coupled with a cathode of the first light-emitting element LED1 and a cathode of the second light-emitting element LED2. The second selection module 300 has a second terminal configured to receive a second control signal. The second control signal is used to control grounding of the cathode of the first light-emitting element LED1 or grounding of the cathode of the second light-emitting element LED2. The switch module 400 has a first terminal coupled with the anode of the first light-emitting element and the anode of the second light-emitting element. The switch module 400 has a second terminal coupled with the cathode of the first light-emitting element and the cathode of the second light-emitting element. The switch module 400 has a third terminal configured to receive a third control signal and a fourth control signal. The third control signal is used to control simultaneous conduction or non-simultaneous conduction of the anode of the first light-emitting element LED1 and the anode of the second light-emitting element LED2. The fourth control signal is used to control simultaneous conduction or non-simultaneous conduction of the cathode of the first light-emitting element LED1 and the cathode of the second light-emitting element LED2. According to the disclosure, the dual-electrode separation in the sub-pixel structure is realized by arranging two light-emitting elements. Two anodes, as well as two cathodes, of the two light-emitting elements are separated and independent. As such, switching of multiple light-emitting modes and light-emitting display of different regions are realized. The intermittent operation of each light-emitting element avoids loading the driving current for long periods, prolongs the service life, and reduces afterimage formed due to difference in material decay.

Figure 2:
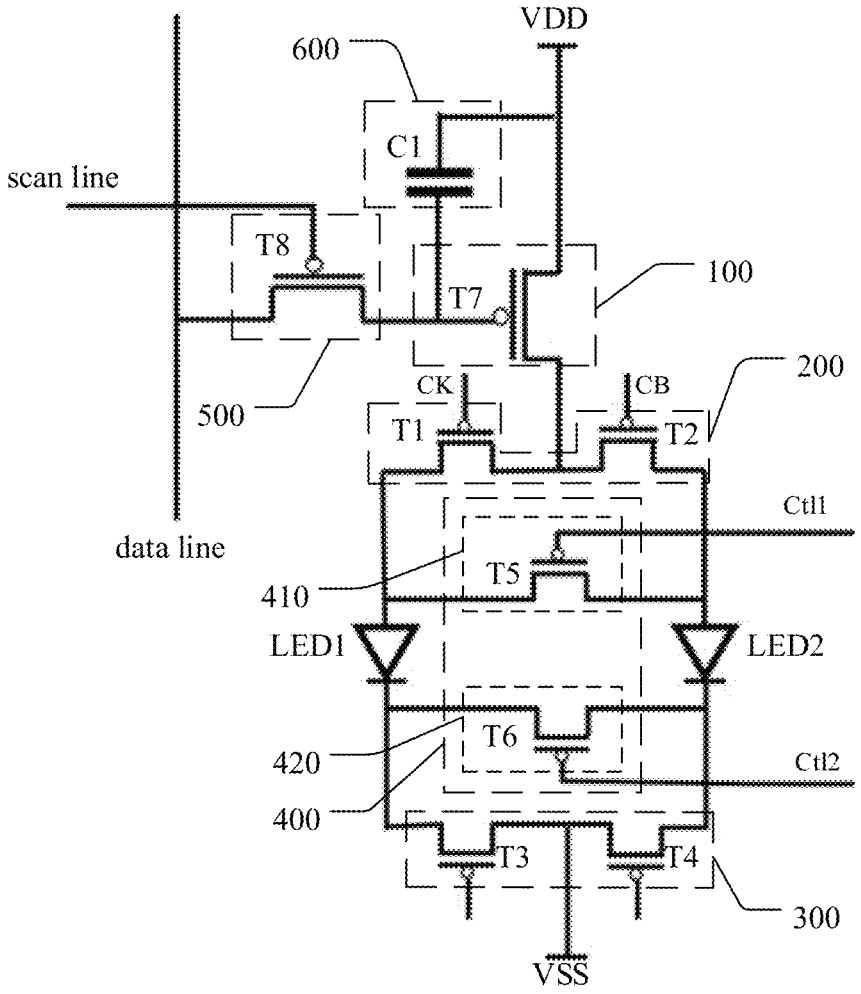
FIG. 2 is a functional block of circuits of a sub-pixel structure of the disclosure.

Referring to FIG. 2, the switch module 400 includes a first switch unit 410 and a second switch unit 420. The first switch unit 410 has a first terminal coupled with the anode of the first light-emitting element LED1, a second terminal coupled with the anode of the second light-emitting element LED2, and a third terminal configured to receive the third control signal Ctl1. The third control signal Ctl1 is used to control simultaneous conduction or non-simultaneous conduction of the anode of the first light-emitting element LED1 and the anode of the second light-emitting element LED2. The second switch unit 420 has a first terminal coupled with the cathode of the first light-emitting element LED1, a second terminal coupled with the cathode of the second light-emitting element LED2, and a third terminal configured to receive the fourth control signal Ctl2. The fourth control signal Ctl2 is used to control simultaneous conduction or non-simultaneous conduction of the cathode of the first light-emitting element LED1 and the cathode of the second light-emitting element LED2. In this implementation, the first switch unit 410 and the second switch unit 420 are respectively coupled to the third control signal Ctl1 and the fourth control signal Ctl2, which are used to control the anodes and the cathodes of dual separation electrodes, respectively. In an implementation, the first switch unit 410 is turned on when the third control signal Ctl1 is a high level, such that the anode of the first light-emitting element LED1 and the anode of the second light-emitting element LED2 are coupled and can be conducted simultaneously. The first switch unit 410 is turned off when the third control signal Ctl1 is a low level, such that the anode of the first light-emitting element LED1 and the anode of the second light-emitting element LED2 are uncoupled and can be conducted non-simultaneously. The second switch unit 420 is controlled by the fourth control signal Ctl2. The second switch unit 420 is turned on when the fourth control signal Ctl2 is a high level, such that the cathode of the first light-emitting element LED1 and the cathode of the second light-emitting element LED2 are coupled and can be conducted simultaneously. The second switch unit 420 is turned off when the fourth control signal Ctl2 is a low level, such that the cathode of the first light-emitting element LED1 and the cathode of the second light-emitting element LED2 are uncoupled and can be conducted non-simultaneously. As such, it is possible to control whether the two anodes, as well as, the two cathodes of the two light-emitting elements are simultaneously conducted, so as to facilitate subsequent switching of multiple light-emitting modes and light-emitting display in different regions.

Figure 3:
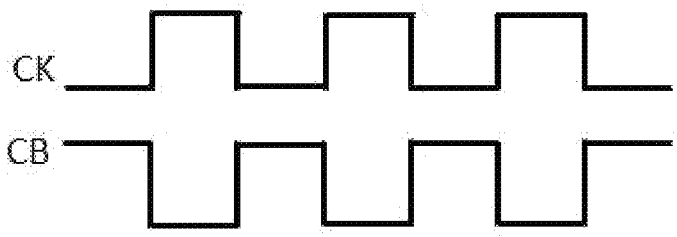
FIG. 3 is a timing diagram of a control signal CK and a control signal CB of a sub-pixel structure of the disclosure.

Referring to FIG. 2, the first selection module 200 includes a first switch transistor T1 and a second switch transistor T2. The first switch transistor T1 has a first terminal coupled with the driving module 100, a second terminal coupled with the anode of the first light-emitting element LED1, and a third terminal configured to receive the first control signal. The second switch transistor T2 has a first terminal coupled with the driving module 100, a second terminal coupled with the anode of the second light-emitting element LED2, and a third terminal configured to receive the first control signal. In this implementation, the first control signal includes a signal CK and a signal CB. The first switch transistor T1 is controlled by the first control signal CK. The second switch transistor T2 is controlled by the second control signal CB. The control timings of the first control signal CK and the first control signal CB are complementary, as illustrated in FIG. 3. When the first control signal CK controls the first switch transistor T1 to be turned on (or turned off), the first control signal CB controls the second switch transistor T2 to be turned off (or turned on). In this way, an output path of the driving current of the driving module 100 can be changed by controlling the on and off of the first switch transistor T1 and the second switch transistor T2, so as to realize the light-emitting display in different regions.

In an implementation, the second selection module 300 includes a third switch transistor T3 and a fourth switch transistor T4. The third switch transistor T3 has a first terminal coupled with the cathode of the first light-emitting element LED2, a second terminal configured to receive the second control signal, and a third terminal coupled with a second supply terminal VSS. The fourth switch transistor T4 has a first terminal coupled with the cathode of the second light-emitting element, a second terminal configured to receive the second control signal, and a third terminal coupled with the second supply terminal VSS. Similarly, in this implementation, the second control signal includes two signals which are respectively used to control the turn on or turn off of the third switch transistor T3 and the fourth switch transistor T4, and whose control timings are also complementary. When the third switch transistor T3 is turned on (or turned off), the fourth switch transistor T4 is turned off (or turned on). As such, the second control signal controls the on and off of the third switch transistor T3 and the fourth switch transistor T4 to enable grounding paths of the light-emitting elements to be changeable.

In an implementation, the first switch unit 410 includes a fifth switch transistor T5. The fifth switch transistor T5 has a first terminal coupled with the anode of the first light-emitting element LED1, a second terminal coupled with the anode of the second light-emitting element LED2, and a third terminal configured to receive the third control signal Ctl1. The third control signal Ctl1 controls whether the anode of the first light-emitting element LED1 and the anode of the second light-emitting element LED2 are simultaneously conducted by controlling the turn on or turn off of the fifth switch transistor T5. In an implementation, when the third control signal Ctl1 controls the fifth switch transistor T5 to be turned on, the anodes of the first light-emitting element LED1 and the second light-emitting element LED2 are simultaneously conducted. At this point, no matter which one of the first switch transistor T1 and the second switch transistor T2 is turned on, the driving current of the driving module 100 will flow to the anodes of the first light-emitting element LED1 and the second light-emitting element LED2 at the same time.

In an implementation, the second switch unit 420 includes a sixth switch transistor T6. The sixth switch transistor T6 includes a first terminal coupled with the cathode of the first light-emitting element LED1, a second terminal coupled with the cathode of the second light-emitting element LED2, and a third terminal configured to receive the fourth control signal Ctl2. The fourth control signal Ctl2 controls whether the cathode of the first light-emitting element LED1 and the cathode of the second light-emitting element LED2 are simultaneously conducted by controlling the turn on or turn off of the sixth switch transistor T6. In an implementation, when the fourth control signal Ctl2 controls the sixth switch transistor T6 to be turned on, the cathodes of the first light-emitting element LED1 and the second light-emitting element LED2 are simultaneously conducted. At this point, no matter which one of the third switch transistor T3 and the fourth switch transistor T4 is turned on, the cathodes of the first light-emitting element LED1 and the second light-emitting element LED2 are simultaneously conducted to the ground.

In an implementation, the driving module 100 includes a seventh switch transistor T7. The seventh switch transistor T7 has a first terminal VDD coupled with the first supply terminal, a second terminal coupled with the first selection module 200, and a third terminal coupled with a control signal input terminal. A control signal inputted from the control signal input terminal is used to control the turn-on or turn-off of the seventh switch transistor T7. When the seventh switch transistor T7 is turned on, the driving current is provided for the first light-emitting element LED1 and/or the second light-emitting element LED2, so as to drive the first light-emitting element LED1 and/or the second light-emitting element LED2 to light up.

In an implementation, the sub-pixel structure further includes a data module 500 and a maintenance module 600. The data module 500 is coupled with a scan line, a data line, and the driving module 100. The maintenance module 600 has one terminal coupled with the first supply terminal VDD and the other terminal coupled with a first terminal of the data module 500 and a third terminal of the driving module 100. The data module 500 has a second terminal coupled with the data line and a third terminal coupled with the scan line. The scan line is configured to turn on or turn off the data module 500. The data line is configured to provide data information when the data module 500 is turned on. The maintenance module 600 is configured to maintain a stable potential difference between the driving module 100 and the first supply terminal VDD, so as to ensure that the driving module 100 can provide effective driving current, as well as data information needed for display, for the first light-emitting element LED1 and the second light-emitting element LED2.

In an implementation, the data module 500 includes an eighth switch transistor T8. The eighth switch transistor T8 has a first terminal coupled with the data line, a second terminal coupled with the third terminal of the seventh switch transistor T7 and the other terminal of the maintenance module 600, and a third terminal coupled with the scan line. The scan line controls the turn on or turn off of the eighth switch transistor T8. When the eighth switch transistor T8 is turned on, the data information of the data line is output to the seventh switch transistor T7 through the eighth switch transistor T8, and the seventh switch transistor T7 is turned on, so as to realize the drive control of the first light-emitting element LED1 or/and the second light-emitting element LED2.

In an implementation, the maintenance module 600 includes a capacitor C1. The capacitor C1 has one terminal coupled with the first supply terminal VDD, and the other terminal coupled with the second terminal of the eighth switch transistor T8 and the third terminal of the seventh switch transistor T7. The capacitor C1 can maintain a stable potential difference between the first supply terminal VDD and the third terminal of the seventh switch transistor T7, thereby ensuring normal drive control of the seventh switch transistor T7.

In an implementation, when the scan line controls the eighth switch transistor T8 to be turned on, the data information is output to the seventh switch transistor T7 through the eighth switch transistor T8, and the seventh switch transistor T7 is controlled to be turned on to provide the driving current for the light emitting elements. Since the two-electrode separation structure is provided in the present disclosure, the driving current will not directly flow through the light-emitting element. Instead, the driving current will be outputted to the light-emitting element after passing through the first switch transistor T1 or the second switch transistor T2. In combination with the first control signal, the second control signal, the third control signal, and each switch transistor, the pixel structure of the disclosure can provide three display states, that is, a low grayscale state, a medium brightness state, and a high brightness state.

In the grayscale state, the first control signal CK controls the first switch transistor T1 to be turned on, the first control signal CB controls the second switch transistor T2 to be turned off, the third control signal Ctl1 controls the fifth switch transistor T5 to be turned off, the fourth control signal Ctl2 controls the sixth switch transistor T6 to be turned on, and the second control signal controls the third switch transistor T3 to be turned off and controls the fourth switch transistor T4 to be turned on. At this time, the anode of the first light-emitting element LED1 receives the driving current, the cathode of the first light-emitting element LED1 is not conducted to the ground, and the cathode of the second light-emitting element LED2 is conducted to the ground. At such, the driving current flows into the anode of the first light-emitting element LED1 through the first switch transistor T1, then flows from the cathode of the first switch transistor T1 to the sixth switch transistor T6, and flows to the ground from the cathode of the second light-emitting element LED2, so that the first light-emitting element LED1 is lighted up. Alternatively, the first control signal CK controls the first switch transistor T1 to be turned off, the first control signal CB controls the second switch transistor T2 to be turned on, the third control signal Ctl1 controls the fifth switch transistor T5 to be turned off, the fourth control signal Ctl2 controls the sixth switch transistor T6 to be turned on, the second control signal controls the third switch transistor T3 to be turned on and controls the fourth switch transistor T4 to be turned off. At this time, the anode of the second light-emitting element LED2 receives the driving current, and the cathode of the first light-emitting element LED1 is conducted to the ground. As such, the driving current flows through the second light-emitting element LED2 via the second switch transistor T2, so that the second light-emitting element LED2 is lighted up. In other words, when the driving current flows through the anode of only one of the two light-emitting elements and the cathode of the other light-emitting element to the ground, the sub-pixel structure is in the low grayscale state, the brightness is the lowest, and there is only one light-emitting element displaying, which results in a displaying of small area. In this implementation, the first light-emitting element LED1 is a micro LED. The first light-emitting element LED1 and the second light-emitting element LED2 are LEDs of the same color.

In the medium brightness state, the first control signal CK controls the first switch transistor T1 to be turned on, the first control signal CB controls the second switch transistor T1 to be turned off, the third control signal Ctl1 controls the fifth switch transistor T5 to be turned off, and the fourth control signal Ctl2 controls the sixth switch transistor T6 to be turned off, the second control signal controls the third switch transistor T3 to be turned on and controls the fourth switch transistor T4 to be turned off. At this time, the cathode of the first light-emitting element LED1 is grounded and the first light-emitting element LED1 is turned on. The driving current flows through the first light-emitting element LED1 via the first switch transistor T1, so that the first light-emitting element LED1 is lighted up. Alternatively, the first control signal CK controls the first switch transistor T1 to be turned off, the first control signal CB controls the second switch transistor T2 to be turned on, the third control signal Ctl1 controls the fifth switch transistor T5 to be turned off, and the fourth control signal Ctl2 controls the sixth switch transistor T6 to be turned off, and the second control signal controls the third switch transistor T3 to be turned off and controls the fourth switch transistor T4 to be turned on. At this time, the cathode of the second light-emitting element LED2 is grounded and the second light-emitting element LED2 is turned on. The driving current flows through the second light-emitting element LED2 via the second switch transistor T2, so that the second light-emitting element LED2 is lighted up. In other words, when the driving current flows through the anode and cathode of only one of the two light-emitting elements to the ground, the sub-pixel structure is in the medium brightness state, and there is only one light-emitting element displaying, and the medium grayscale display is obtained.

In the high brightness state, the first control signal CK controls the first switch transistor T1 to be turned on, the first control signal CB controls the second switch transistor T2 to be turned off, the third control signal Ctl1 controls the fifth switch transistor T5 to be turned on, and the fourth control signal Ctl2 controls the sixth switch transistor T6 to be turned on, and the second control signal controls the third switch transistor T3 to be turned on and controls the fourth switch transistor T4 to be turned off. At this time, the driving current flows into the anode of the first light-emitting element LED1 and the anode of the second light-emitting element LED2 at the same time, and the cathode of the first light-emitting element LED1 and the cathode of the second light-emitting element LED2 are conducted to the ground at the same time. The driving current flows through the first light-emitting element LED1 and the second light-emitting element LED2 via the first switch transistor T1, the cathode of the first light-emitting element LED1 and the cathode of the second light-emitting element LED2 are both conducted to the ground through the third switch transistor T3. Alternatively, the first control signal CK controls the first switch transistor T1 to be turned off, the first control signal CB controls the second switch transistor T2 to be turned on, the third control signal Ctl1 controls the fifth switch transistor T5 to be turned on, the fourth control signal Ctl2 controls the sixth switch transistor T6 to be turned on, and the second control signal controls the third switch transistor T3 to be turned off and controls the fourth switch transistor T4 to be turned on. At this time, the driving current flows into the anode of the first light-emitting element LED1 and the anode of the second light-emitting element LED2 at the same time, and the cathode of the first light-emitting element LED1 and the cathode of the second light-emitting element LED2 are conducted to the ground at the same time. The driving current flows through the first light-emitting element LED1 and the second light-emitting element LED2 via the second switch transistor T2, the cathode of the first light-emitting element LED1 and the cathode of the second light-emitting element LED2 are both conducted to the ground through the fourth switch transistor T4. In other words, in the high brightness state, the first light-emitting element LED1 and the second light-emitting element LED2 are all turned on to light up.

Lighting up two light-emitting elements in the high brightness state allows has a larger light-emitting area than lighting up only one light-emitting element. A larger light-emitting area corresponds to a greater pixels per inch (PPI) of a display panel in the display. A greater PPI means that the display can display images with higher density, the graininess will be reduced, and the brightness of the display panel will be increased, which results in a high grayscale display. When only one light-emitting element emits light for displaying, the brightness of the display panel will be low, which results in a low grayscale display. As such, different brightness displays can be obtained by selecting different modes, but the driving current will not be small, and precise control can be achieved, thereby avoiding display unevenness due to a small current in the low grayscale display.

Figure 4:
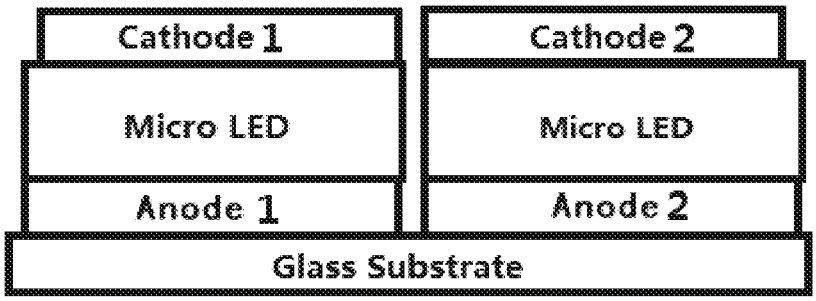
FIG. 4 is a schematic structural diagram of two light-emitting elements in a sub-pixel structure of the disclosure.

Referring to FIG. 4, in the sub-pixel structure of the disclosure, two light-emitting elements are provided to realize a dual-electrode separation structure, that is, the sub-pixel structure has two anodes (i.e., anode 1 and anode 2) and two cathodes (i.e., cathode 1 and cathode 2), two anodes are separately arranged and two cathodes are separately arranged. In comparison with the traditional uni-electrode structure, the dual-electrode separation structure of the disclosure can switch multiple light-emitting modes and realize light-emitting display of different regions by adjusting the timing of the control signal according to actual requirements. In this way, the intermittent operation of each light-emitting element avoids loading the driving current for long periods, prolongs the service life, and reduces afterimage formed due to difference in material decay. The control signals CK, CB, and Ctl are all controlled by a timing controller to display grayscales according to actual requirements. A desired display mode can be selected after analyzing data. At this point, dual electrodes of the sub-pixel structure can be evenly distributed, for example, into a circle shape, a square shape, or a double-F shape, to ensure uniformity of display.

In an implementation, each of the first switch transistor T1, the second switch transistor T2, the third switch transistor T3, the fourth switch transistor T4, the fifth switch transistor T5, the sixth switch transistor T6, the seventh switch transistor T7, and the eighth switch transistor T8 is a thin film transistor.

It is noted that the above-mentioned first terminal can be a source or a drain, the second terminal can be a drain or a source, and the third terminal is a gate.

A display is further provided. The display includes a pixel array. The pixel array includes at least one pixel circuit. The at least one pixel circuit includes the above-mentioned three sub-pixel structures. The sub-pixel structure has been described in detail above, and will not be repeated herein.

The pixel array and the display are provided. The sub-pixel structure includes the driving module, the first selection module, the second selection module, the switch module, the first light-emitting element, and the second light-emitting element. The first selection module is configured to control conduction between the driving module and the anode of the first light-emitting element or conduction between the driving module and the anode of the second light-emitting element through the first control signal. The second selection module is configured to control grounding of the cathode of the first light-emitting element or grounding of the cathode of the second light-emitting element through the second control signal. The switch module is configured to control simultaneous conduction or non-simultaneous conduction of the anode of the first light-emitting element and the anode of the second light-emitting element through the third control signal and to control simultaneous conduction or non-simultaneous conduction of the cathode of the first light-emitting element and the cathode of the second light-emitting element through the fourth control signal. By using dual-electrode separation, it is possible to achieve display of time-sharing control and zone control, slow down the decay rate of material, prolong the service life, and reduce afterimage formed due to difference in material decay.

It is noted that for those of ordinary skill in the art, equivalent replacements or variations can be made according to the technical solution of the present disclosure and its inventive concept, and these replacements or variations are also considered to fall into the protection scope of the appended claims of the present disclosure.

What is claimed is:

1. A sub-pixel structure, comprising a driving module, a first selection module, a second selection module, a switch module, a first light-emitting element, and a second light-emitting element, wherein the driving module has a first terminal coupled with a first supply terminal and a second terminal coupled to a first terminal of the first selection module;

the first selection module has a second terminal coupled with an anode of the first light-emitting element and an anode of the second light-emitting element, and has a third terminal configured to receive a first control signal, wherein the first control signal is used to control conduction between the driving module and the anode of the first light-emitting element or conduction between the driving module and the anode of the second light-emitting element;

the second selection module has a first terminal coupled with a cathode of the first light-emitting element and a cathode of the second light-emitting element, and has a second terminal configured to receive a second control signal, wherein the second control signal is used to control grounding of the cathode of the first light-emitting element or grounding of the cathode of the second light-emitting element;

the switch module has a first terminal coupled with the anode of the first light-emitting element and the anode of the second light-emitting element, and has a second terminal coupled with the cathode of the first light-emitting element and the cathode of the second light-emitting element; and the switch module has a third terminal configured to receive a third control signal and a fourth control signal, wherein the third control signal is used to control simultaneous conduction or non-simultaneous conduction of the anode of the first light-emitting element and the anode of the second light-emitting element, and the fourth control signal is used to control simultaneous conduction or non-simultaneous conduction of the cathode of the first light-emitting element and the cathode of the second light-emitting element; wherein the switch module comprises a first switch unit and a second switch unit;

the first switch unit has a first terminal coupled with the anode of the first light-emitting element, a second terminal coupled with the anode of the second light-emitting element, and a third terminal configured to receive the third control signal;

the second switch unit has a first terminal coupled with the cathode of the first light-emitting element, a second terminal coupled with the cathode of the second light-emitting element, and a third terminal configured to receive the fourth control signal; and when in a grayscale state, the first switch unit is turned off and the second switch unit is turned on, wherein the anode of the first light-emitting element is conducted to the driving module and the cathode of the second light-emitting element is grounded, a driving current flows from the anode of the first light-emitting element to the cathode of the first light-emitting element, and then to a ground via the second switch unit and the cathode of the second light-emitting element, so that the first light-emitting element is lighted up and the second light-emitting element is not lighted up; or the anode of the second light-emitting element is conducted to the driving module and the cathode of the first light-emitting element is grounded, a driving current flows from the anode of the second light-emitting element to the cathode of the second light-emitting element, and then to the ground via the second switch unit and the cathode of the first light-emitting element, so that the second light-emitting element is lighted up and the first light-emitting element is not lighted up.

2. The sub-pixel structure of claim 1, wherein the first selection module comprises a first switch transistor and a second switch transistor;

the first switch transistor has a first terminal coupled with the driving module, a second terminal coupled with the anode of the first light-emitting element, and a third terminal configured to receive the first control signal; and the second switch transistor has a first terminal coupled with the driving module, a second terminal coupled with the anode of the second light-emitting element, and a third terminal configured to receive the first control signal.

3. The sub-pixel structure of claim 1, wherein the second selection module comprises a third switch transistor and a fourth switch transistor;

the third switch transistor has a first terminal coupled with the cathode of the first light-emitting element, a second terminal configured to receive the second control signal, and a third terminal coupled with a second supply terminal; and the fourth switch transistor has a first terminal coupled with the cathode of the second light-emitting element, a second terminal configured to receive the second control signal, and a third terminal coupled with the second supply terminal.

4. The sub-pixel structure of claim 1, wherein the first switch unit comprises a fifth switch transistor, and the fifth switch transistor has a first terminal coupled with the anode of the first light-emitting element, a second terminal coupled with the anode of the second light-emitting element, and a third terminal configured to receive the third control signal.

5. The sub-pixel structure of claim 1, wherein the second switch unit comprises a sixth switch transistor, and the sixth switch transistor comprises a first terminal coupled with the cathode of the first light-emitting element, a second terminal coupled with the cathode of the second light-emitting element, and a third terminal configured to receive the fourth control signal.

6. The sub-pixel structure of claim 1, wherein the driving module comprises a seventh switch transistor, and the seventh switch transistor has a first terminal coupled with the first supply terminal, a second terminal coupled with the first selection module, and a third terminal coupled with a control signal input terminal.

7. The sub-pixel structure of claim 1, further comprising a data module and a maintenance module, wherein the data module is coupled with a scan line, a data line, and the driving module;

the maintenance module has one terminal coupled with the first supply terminal and the other terminal coupled with a first terminal of the data module and a third terminal of the driving module, wherein the maintenance module is configured to maintain a stable potential difference between the driving module and the first supply terminal;

the data module has a second terminal coupled with the data line and a third terminal coupled with the scan line;

the scan line is configured to turn on or turn off the data module; and the data line is configured to provide data information when the data module is turned on.

8. The sub-pixel structure of claim 7, wherein the data module comprises an eighth switch transistor, and the eighth switch transistor has a first terminal coupled with the data line, a second terminal coupled with the third terminal of the driving module and the other terminal of the maintenance module, and a third terminal coupled with the scan line.

9. A display, comprising a pixel array, wherein the pixel array comprises at least one pixel circuit, and the at least one pixel circuit comprises three sub-pixel structures, each of the three sub-pixel structures comprises a driving module, a first selection module, a second selection module, a switch module, a first light-emitting element, and a second light-emitting element, wherein the driving module has a first terminal coupled with a first supply terminal and a second terminal coupled to a first terminal of the first selection module;

the first selection module has a second terminal coupled with an anode of the first light-emitting element and an anode of the second light-emitting element, and has a third terminal configured to receive a first control signal, wherein the first control signal is used to control conduction between the driving module and the anode of the first light-emitting element or conduction between the driving module and the anode of the second light-emitting element;

the second selection module has a first terminal coupled with a cathode of the first light-emitting element and a cathode of the second light-emitting element, and has a second terminal configured to receive a second control signal, wherein the second control signal is used to control grounding of the cathode of the first light-emitting element or grounding of the cathode of the second light-emitting element;

the switch module has a first terminal coupled with the anode of the first light-emitting element and the anode of the second light-emitting element, and has a second terminal coupled with the cathode of the first light-emitting element and the cathode of the second light-emitting element; and the switch module has a third terminal configured to receive a third control signal and a fourth control signal, wherein the third control signal is used to control simultaneous conduction or non-simultaneous conduction of the anode of the first light-emitting element and the anode of the second light-emitting element, and the fourth control signal is used to control simultaneous conduction or non-simultaneous conduction of the cathode of the first light-emitting element and the cathode of the second light;

the switch module comprises a first switch unit and a second switch unit;

the first switch unit has a first terminal coupled with the anode of the first light-emitting element, a second terminal coupled with the anode of the second light-emitting element, and a third terminal configured to receive the third control signal;

the second switch unit has a first terminal coupled with the cathode of the first light-emitting element, a second terminal coupled with the cathode of the second light-emitting element, and a third terminal configured to receive the fourth control signal; and when in a grayscale state, the first switch unit is turned off and the second switch unit is turned on, wherein the anode of the first light-emitting element is conducted to the driving module and the cathode of the second light-emitting element is grounded, a driving current flows from the anode of the first light-emitting element to the cathode of the first light-emitting element, and then to a ground via the second switch unit and the cathode of the second light-emitting element, so that the first light-emitting element is lighted up and the second light-emitting element is not lighted up; or the anode of the second light-emitting element is conducted to the driving module and the cathode of the first light-emitting element is grounded, a driving current flows from the anode of the second light-emitting element to the cathode of the second light-emitting element, and then to the ground via the second switch unit and the cathode of the first light-emitting element, so that the second light-emitting element is lighted up and the first light-emitting element is not lighted up.

10. The display of claim 9, wherein the first selection module comprises a first switch transistor and a second switch transistor;

the first switch transistor has a first terminal coupled with the driving module, a second terminal coupled with the anode of the first light-emitting element, and a third terminal configured to receive the first control signal; and the second switch transistor has a first terminal coupled with the driving module, a second terminal coupled with the anode of the second light-emitting element, and a third terminal configured to receive the first control signal.

11. The display of claim 9, wherein the second selection module comprises a third switch transistor and a fourth switch transistor;

the third switch transistor has a first terminal coupled with the cathode of the first light-emitting element, a second terminal configured to receive the second control signal, and a third terminal coupled with a second supply terminal; and the fourth switch transistor has a first terminal coupled with the cathode of the second light-emitting element, a second terminal configured to receive the second control signal, and a third terminal coupled with the second supply terminal.

12. The display of claim 9, wherein the first switch unit comprises a fifth switch transistor, and the fifth switch transistor has a first terminal coupled with the anode of the first light-emitting element, a second terminal coupled with the anode of the second light-emitting element, and a third terminal configured to receive the third control signal.

13. The display of claim 9, wherein the second switch unit comprises a sixth switch transistor, and the sixth switch transistor comprises a first terminal coupled with the cathode of the first light-emitting element, a second terminal coupled with the cathode of the second light-emitting element, and a third terminal configured to receive the fourth control signal.

14. The display of claim 9, wherein the driving module comprises a seventh switch transistor, and the seventh switch transistor has a first terminal coupled with the first supply terminal, a second terminal coupled with the first selection module, and a third terminal coupled with a control signal input terminal.

15. The display of claim 9, further comprising a data module and a maintenance module, wherein the data module is coupled with a scan line, a data line, and the driving module;

the maintenance module has one terminal coupled with the first supply terminal and the other terminal coupled with a first terminal of the data module and a third terminal of the driving module, wherein the maintenance module is configured to maintain a stable potential difference between the driving module and the first supply terminal;

the data module has a second terminal coupled with the data line and a third terminal coupled with the scan line;

the scan line is configured to turn on or turn off the data module; and the data line is configured to provide data information when the data module is turned on.

16. The display of claim 15, wherein the data module comprises an eighth switch transistor, and the eighth switch transistor has a first terminal coupled with the data line, a second terminal coupled with the third terminal of the driving module and the other terminal of the maintenance module, and a third terminal coupled with the scan line.

17. A sub-pixel structure, comprising a driving module, a first selection module, a second selection module, a switch module, a first light-emitting element, and a second light-emitting element, the first light-emitting element and the second light-emitting element being separated from each other and capable of being separately lighted up, wherein the driving module has a first terminal coupled with a first supply terminal and a second terminal coupled to a first terminal of the first selection module;

the first selection module has a second terminal coupled with an anode of the first light-emitting element and an anode of the second light-emitting element, and has a third terminal configured to receive a first control signal, wherein the first control signal is used to control conduction between the driving module and the anode of the first light-emitting element or conduction between the driving module and the anode of the second light-emitting element;

the second selection module has a first terminal coupled with a cathode of the first light-emitting element and a cathode of the second light-emitting element, and has a second terminal configured to receive a second control signal, wherein the second control signal is used to control grounding of the cathode of the first light-emitting element or grounding of the cathode of the second light-emitting element;

the switch module has a first terminal coupled with the anode of the first light-emitting element and the anode of the second light-emitting element, and has a second terminal coupled with the cathode of the first light-emitting element and the cathode of the second light-emitting element; and the switch module has a third terminal configured to receive a third control signal and a fourth control signal, wherein the third control signal is used to control the switch module to non-simultaneously conduct the anode of the first light-emitting element and the anode of the second light-emitting element, and the fourth control signal is used to control the switch module to simultaneously conduct the cathode of the first light-emitting element and the cathode of the second light-emitting element, so that a driving current flows through one of the first light-emitting element and the second light-emitting to a ground via the cathode of the other of the first light-emitting element and the second light-emitting, and the first light-emitting element and the second light-emitting are non-simultaneously lighted up.

18. The sub-pixel structure of claim 17, wherein the switch module comprises a first switch unit and a second switch unit;

the first switch unit has a first terminal coupled with the anode of the first light-emitting element, a second terminal coupled with the anode of the second light-emitting element, and a third terminal configured to receive the third control signal; and the second switch unit has a first terminal coupled with the cathode of the first light-emitting element, a second terminal coupled with the cathode of the second light-emitting element, and a third terminal configured to receive the fourth control signal.

19. The sub-pixel structure of claim 17, wherein the first selection module comprises a first switch transistor and a second switch transistor;

the first switch transistor has a first terminal coupled with the driving module, a second terminal coupled with the anode of the first light-emitting element, and a third terminal configured to receive the first control signal; and the second switch transistor has a first terminal coupled with the driving module, a second terminal coupled with the anode of the second light-emitting element, and a third terminal configured to receive the first control signal.

20. The sub-pixel structure of claim 17, wherein the second selection module comprises a third switch transistor and a fourth switch transistor;

the third switch transistor has a first terminal coupled with the cathode of the first light-emitting element, a second terminal configured to receive the second control signal, and a third terminal coupled with a second supply terminal; and the fourth switch transistor has a first terminal coupled with the cathode of the second light-emitting element, a second terminal configured to receive the second control signal, and a third terminal coupled with the second supply terminal.

* * * * *